US011564428B2

(12) United States Patent
McIntosh

(10) Patent No.: US 11,564,428 B2
(45) Date of Patent: Jan. 31, 2023

(54) FITNESS GARMENT

(71) Applicant: Donavan Lamont McIntosh, Las Vegas, NV (US)

(72) Inventor: Donavan Lamont McIntosh, Las Vegas, NV (US)

( * ) Notice: Subject to any disclaimer, the term of this patent is extended or adjusted under 35 U.S.C. 154(b) by 0 days.

(21) Appl. No.: 16/136,442

(22) Filed: Sep. 20, 2018

(65) Prior Publication Data

US 2019/0014841 A1 Jan. 17, 2019

Related U.S. Application Data

(63) Continuation-in-part of application No. 29/585,132, filed on Nov. 21, 2016, now Pat. No. Des. 831,932.

(51) Int. Cl.

| | |
|---|---|
| ***A41D 27/28*** | (2006.01) |
| ***A41D 31/00*** | (2019.01) |
| ***A61H 36/00*** | (2006.01) |
| ***A41D 13/00*** | (2006.01) |
| ***A41D 31/102*** | (2019.01) |
| ***A41D 1/04*** | (2006.01) |
| ***A41D 13/01*** | (2006.01) |

(52) U.S. Cl.

CPC ..... *A41D 27/285* (2013.01); *A41D 13/0015* (2013.01); *A41D 31/00* (2013.01); *A41D 31/102* (2019.02); *A61H 36/00* (2013.01); *A41D 1/04* (2013.01); *A41D 13/01* (2013.01); *A41D 2300/322* (2013.01); *A41D 2400/10* (2013.01); *A61H 2201/165* (2013.01)

(58) Field of Classification Search

CPC ... A41B 1/10; A41B 2400/20; A41B 2400/44; A41D 27/28; A41D 27/285; A41D 2300/322; A41D 2400/20; A41D 2400/44

See application file for complete search history.

(56) References Cited

U.S. PATENT DOCUMENTS 2,010,434 A * 8/1935 Langrock ..... A41D 27/28 2/93
2,505,451 A * 4/1950 Weinstock ..... A41D 27/28 2/87

(Continued)

FOREIGN PATENT DOCUMENTS

JP 10259515 A * 9/1998 ..... A41D 13/1245
JP 11050317 A * 2/1999 ..... A41D 27/28

(Continued)

*Primary Examiner* — Sally Haden

(74) *Attorney, Agent, or Firm* — William Hurles; Dickinson Wright PLLC

(57) ABSTRACT

A fitness garment that promotes excessive water weight and body fat loss at targeted areas of the wearer's body. The fitness garment is adjustable, machine washable, and conforms close to the user's body to specifically target problem weight loss areas to ensure maximum results. A lower panel formed of neoprene is held in close conformity to a user's torso to retain body heat at targeted locations. An upper panel is formed of a breathable resilient material and extends around the user's chest and shoulders, when worn. A zipper closure on a front face of the garment is operable to regulate the user's body heat. A lateral side zipper is provided as a closure of a side opening of the lower panel to selectively retain body heat around the user's stomach and back around the waistline.

16 Claims, 4 Drawing Sheets

(56) References Cited

U.S. PATENT DOCUMENTS 2,559,953 A * 7/1951 Evans ..... A41D 1/00 2/70
2,700,769 A * 2/1955 Polchinski ..... A41D 27/28 2/93
2,713,168 A * 7/1955 Bagnato ..... A41D 27/28 2/93
3,153,793 A * 10/1964 Lepore ..... A41D 27/10 2/93
4,554,682 A * 11/1985 Hillquist ..... A41D 3/00 2/102
4,608,715 A * 9/1986 Miller ..... A41D 27/285 2/1
4,651,348 A * 3/1987 Swanson ..... A41D 27/20 2/253
5,282,277 A * 2/1994 Onozawa ..... A41D 13/00 2/69
5,727,256 A * 3/1998 Rudman ..... A41D 27/28 2/115
6,119,270 A * 9/2000 Chou ..... A41D 3/00 2/108
6,298,485 B1 * 10/2001 Heller ..... A41D 3/005 2/126
8,713,712 B2 * 5/2014 Maurer ..... A41D 27/24 2/93
2003/0024028 A1 * 2/2003 Sleesen ..... A41D 13/0158 2/2.17
2004/0133962 A1 * 7/2004 Baumel ..... A41D 27/28 2/108
2004/0154084 A1 * 8/2004 Aldridge ..... A41D 13/00 2/458
2004/0158910 A1 * 8/2004 Bay ..... A41D 3/00 2/69
2005/0034204 A1 * 2/2005 Kassai ..... A41B 13/00 2/69
2005/0273903 A1 * 12/2005 Rudman ..... A41B 1/08 2/69
2006/0174393 A1 * 8/2006 Meged ..... A41D 27/10 2/108
2006/0277652 A1 * 12/2006 Okajima ..... A41D 13/00 2/93
2006/0277653 A1 * 12/2006 Okajima ..... A41D 3/00 2/93
2008/0040832 A1 * 2/2008 Bay ..... A41D 27/28 2/93
2009/0077710 A1 * 3/2009 Bay ..... A41D 3/00 2/87
2009/0178174 A1 * 7/2009 Cash, Jr. ..... A41D 1/08 2/69
2009/0293171 A1 * 12/2009 Fayle ..... A41D 27/10 2/85
2010/0291825 A1 * 11/2010 Johnson ..... B32B 5/24 442/289
2010/0299798 A1 * 12/2010 Fayle ..... A41D 27/10 2/69
2012/0017348 A1 * 1/2012 Ellsworth ..... A41D 3/00 2/85
2012/0096622 A1 * 4/2012 Johnson ..... A41D 15/00 2/93
2013/0117903 A1 * 5/2013 Kanayama ..... A41D 27/28 2/69
2014/0196192 A1 * 7/2014 Koller ..... A41D 3/02 2/85
2015/0101102 A1 * 4/2015 Theodossiou ..... A41D 13/1254 2/114
2015/0374048 A1 * 12/2015 Theodossiou ..... A41D 13/1245 2/114
2016/0081402 A1 * 3/2016 Nixon, Jr. ..... A41D 1/08 2/227
2016/0113339 A1 * 4/2016 Dolcetti ..... A41D 13/0015 2/69
2016/0286872 A1 * 10/2016 Wilson ..... A41D 13/1245
2016/0295937 A1 * 10/2016 Harrington ..... B63C 9/115
2016/0338415 A1 * 11/2016 Aihara ..... A41B 1/08
2017/0020455 A1 * 1/2017 Hou ..... A61B 5/6804
2017/0027246 A1 * 2/2017 Inzer ..... A41D 1/08
2017/0290383 A1 * 10/2017 Arnold ..... A41D 13/0015
2018/0098584 A1 * 4/2018 Pezzimenti ..... A41D 31/065
2018/0098586 A1 * 4/2018 Pezzimenti ..... A41D 31/065
2018/0235290 A1 * 8/2018 Pfanner ..... A41D 15/002
2019/0133214 A1 * 5/2019 Brown ..... A41D 13/0015
2019/0150539 A1 * 5/2019 Hiney ..... A41D 27/10

FOREIGN PATENT DOCUMENTS

JP 2006328597 A * 12/2006 ..... A41D 13/00
JP 2012046859 A * 3/2012 ..... A41D 27/28

* cited by examiner

FITNESS GARMENT

CROSS-REFERENCE TO RELATED APPLICATION

This application is a continuation-in-part application of U.S. patent application No. 29/585,132, filed Nov. 21, 2016, the contents of which are herein incorporated by reference.

BACKGROUND OF THE INVENTION

The present invention relates to fitness garments, and more particularly to fitness garments that promote water weight and body fat loss.

There are a variety of weight loss fitness garments in the art. Some of them are poorly made, basically a baggy vinyl suit. These garments, and others of similar design, do not provide suitable coverage to target weight loss problem areas. In addition, these ill fitted garments have a tendency to catch snag on articles while the user may be working out in a fitness regimen, leading to tears in the garment.

Other fitness garments may be closer fitted to the user, however, no provision is made to accommodate weight loss during the contemplated successful use of the garments. Accordingly, as the user succeeds in their weight loss, they are forced to purchase a new garment to accommodate their weight loss.

As can be seen, there is a need for a fitness garment that is adjustable, machine washable, and conforms close to the body to specifically target problem areas to ensure maximum results.

SUMMARY OF THE INVENTION

In one aspect of the present invention a fitness garment for retaining body heat at targeted areas of a user's torso is disclosed. The fitness garment includes a lower panel formed of a neoprene material. A front face of the lower panel extends from a waistline to a lateral line proximal to a wearer's pectoral muscles when worn. A back face of the lower panel extends from the waistline to a line proximal to a wearer's trapezius muscles when worn. An upper panel extends across the chest and around the shoulders of a user's body when worn, the upper panel is formed of a flexible breathable fabric to permit freedom of arm movement during exercise. A zipper extends from the waistline to a neckline of the front face of the garment to permit the user to don the garment and operate the zipper closure to provide a close fit of the lower panel around the user's torso. The back face of the lower panel has converging arcuate lines dimensioned to encircle the user's shoulders when worn.

In some embodiments, a lateral side zipper extends from the waistline to an upper portion of the lower panel. The lateral zipper is operable to selectively close a lateral side opening of the lower panel from a top end thereof towards the waistline. A closure panel may be attached to an interior of the lateral side opening with the closure panel formed of the flexible breathable fabric.

In other aspects of the invention, a fitness garment for retaining body heat at targeted areas of a user's torso includes a lower panel formed of a neoprene material extending from a waistline to a frontal lateral line proximal to a wearer's pectoral muscles when worn, a back lateral line proximal to a wearer's trapezius muscles when worn, with the front and the back lateral lines interconnected by converging arcuate lines partially circumscribing the user's shoulders when worn. An upper panel extends across the chest and around the shoulders of a user's body, the upper panel formed of a flexible breathable fabric to permit freedom of arm movement. A zipper closure extends from the waistline to a neckline of a front face of the fitness garment to permit the user to don the garment and operate the zipper closure to provide a close fit of the lower panel around the user's torso.

In some embodiments, a lateral side zipper that extends vertically from the waistline to an upper portion of the lower panel, the lateral zipper operable to selectively close a lateral side opening of the lower panel from a top end thereof towards the waistline. The fitness garment may also include a closure panel attached to an interior of the lateral side opening, the closure panel formed of the flexible breathable fabric.

In yet other aspects of the invention, a method to promote targeted water and body fat loss around a user's torso, is disclosed. The method includes providing fitness garment having a lower panel formed of a neoprene material extending from a waistline to a frontal lateral line proximal to a wearer's pectoral muscles when worn, a back lateral line proximal to a wearer's trapezius muscles when worn, the front and the back lateral lines interconnected by converging arcuate lines partially circumscribing the user's shoulders when worn, an upper panel extending across the chest and around the shoulders of a user's body, the upper panel formed of a flexible breathable fabric to permit freedom of arm movement, and a zipper closure extending from the waistline to a neckline of a front face of the fitness garment to permit the user to don the garment and operate the zipper closure to provide a close fit of the lower panel around the user's torso. The user dons the fitness garment over the user's torso. The user may selectively operate the zipper to regulate the body temperature of the user.

In some embodiments, the method also includes providing a lateral side zipper to the fitness garment, the lateral side zipper extending vertically from the waistline to an upper portion of the lower panel. The lateral zipper is operable to selectively close a lateral side opening of the lower panel from a top end thereof towards the waistline. The user selectively operates the lateral side zipper to regulate the body temperature of the user.

These and other features, aspects and advantages of the present invention will become better understood with reference to the following drawings, description and claims.

DETAILED DESCRIPTION OF THE INVENTION

Figure 1:
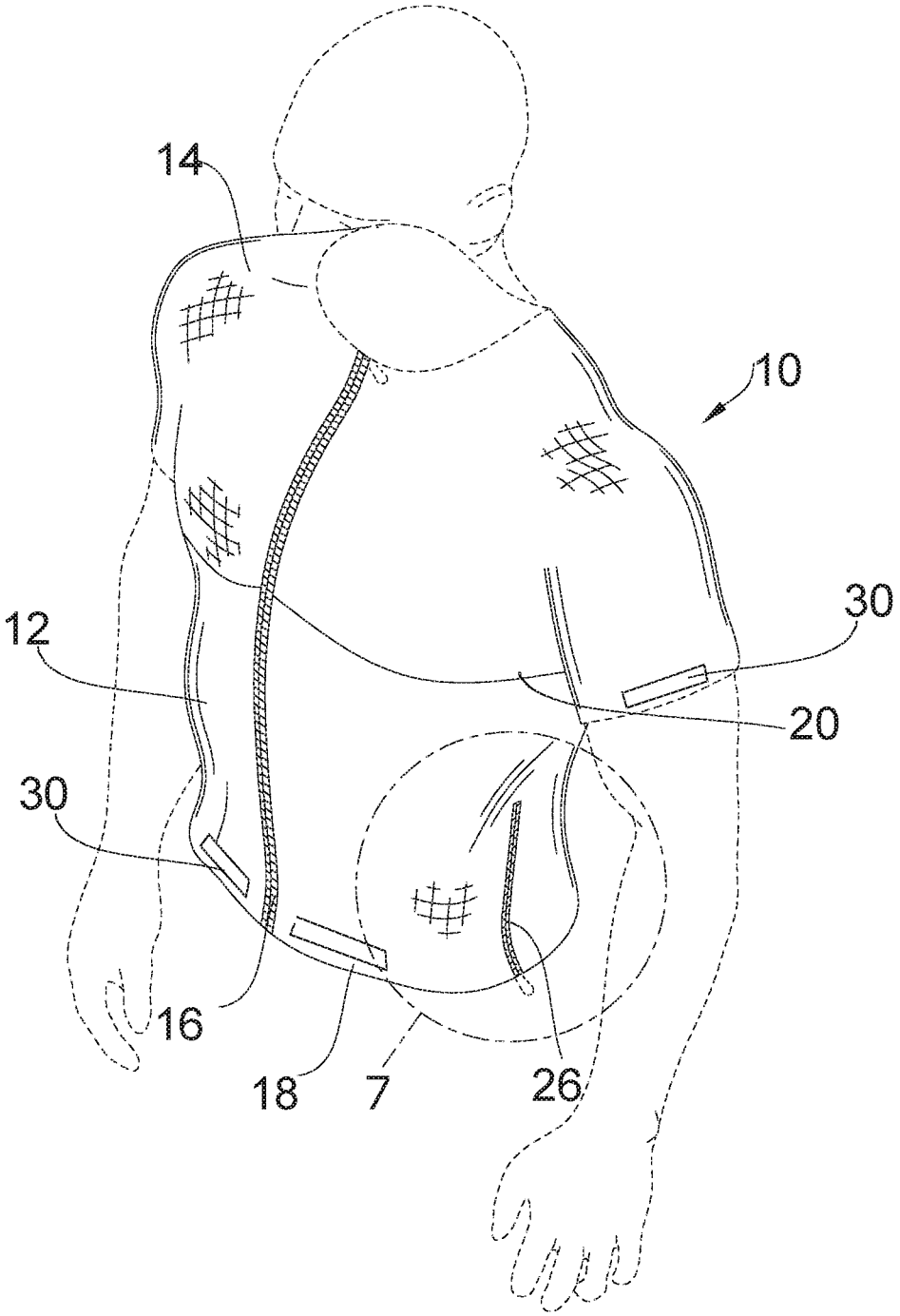
FIG. 1 is a perspective view of the fitness garment in use.
Figure 2:
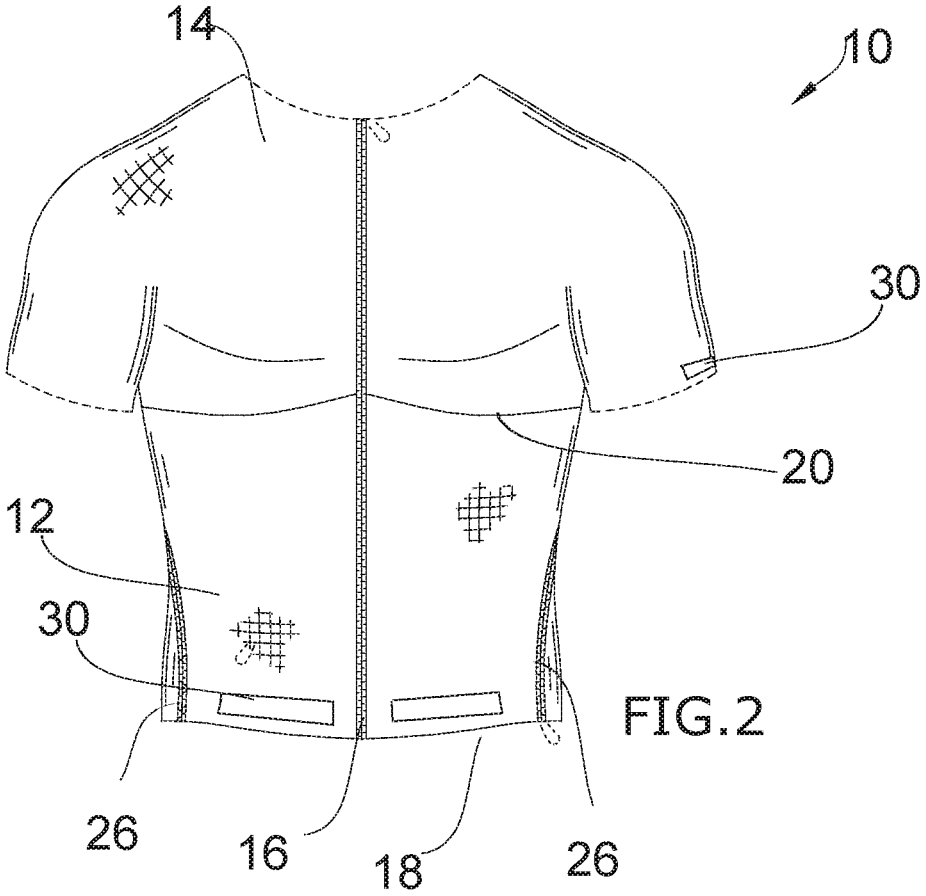
FIG. 2 is a front view thereof.
Figure 3:
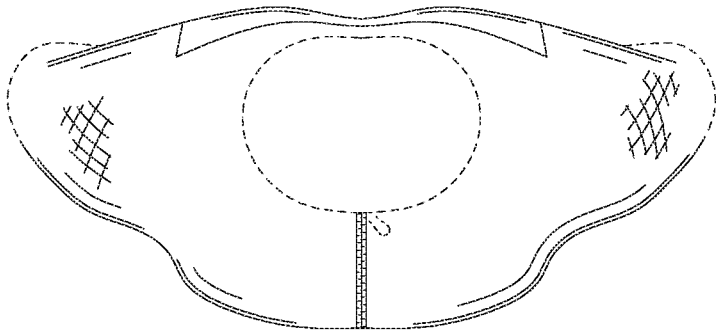
FIG. 3 is a top view thereof.
Figure 4:
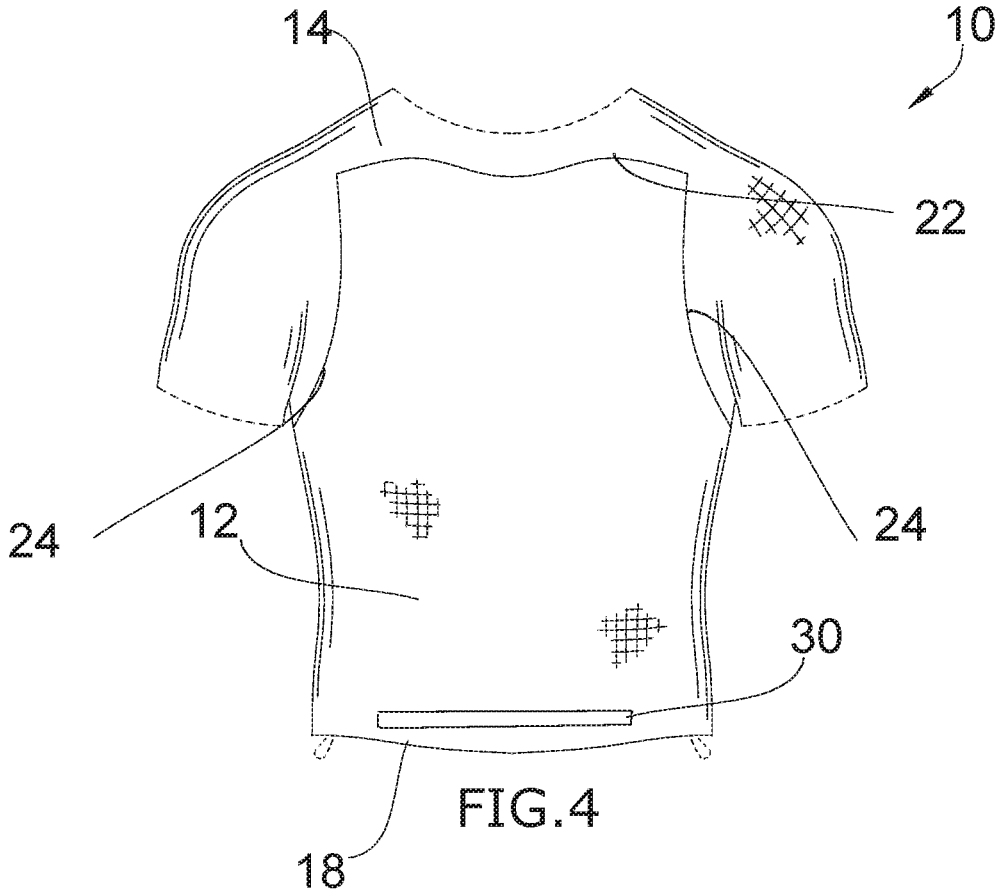
FIG. 4 is a rear view thereof.
Figure 5:
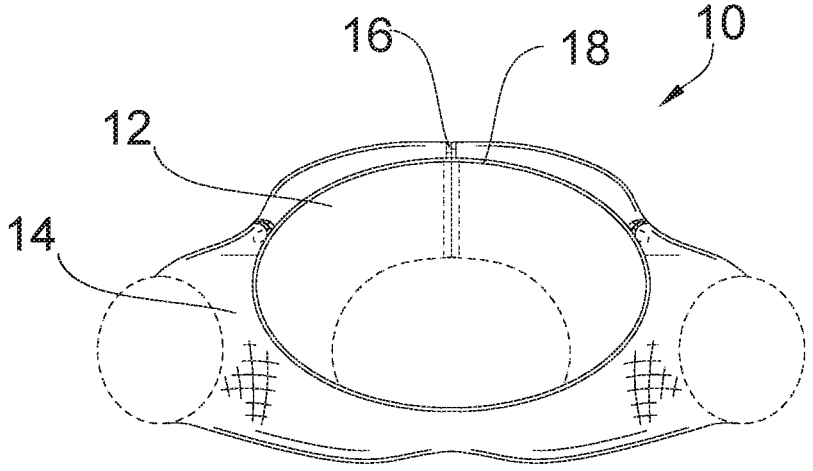
FIG. 5 is a bottom view thereof.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, embodiments of the present invention provide a fitness garment, that is constructed to be worn in a close fitting relation to the user's body. The garment is adjustable about the girth of the user's waist and stomach to accommodate for anticipated weight loss and shredded body fat during the course of its use.

As seen in reference to the drawings of FIGS. 1-7 the fitness garment 10 is of a two part construction to specifically target areas of the torso and upper torso that tend to retain water weight and body fat deposits. The materials used in the lower portion of fitness garment assist in the retention of body heat in the areas covered by the garment, causing the person wearing it to sweat and shed unwanted water weight/body fat, particularly during an exercise regimen. The upper portions of the garment 10 are formed of a close fitting breathable material to prevent the user from overheating.

A lower panel 12 of the fitness garment 10 is formed of a washable, hypoallergenic neoprene type material. An upper panel 14 of the fitness garment 10 is formed of a close fitting stretchable fabric, such as spandex, lycra, or polyester material. A fastener, such as a zipper 16 is provided along a front face of the garment 10 from the waistline to a neck opening so that the user may don the garment 10 and use the font zipper closure 16 so that the garment fit snugly about their body. The user may adjust the front zipper closure 16 to regulate the amount of body heat that is retained to prevent overheating. The upper panel 14 also includes sleeves, which may be either long or short.

The lower panel 12 is shaped to target problem weight loss areas of the abdomen and back. A front face of lower panel 12 of the garment 10 extends from a waistline 18 to a lateral line 20 proximal to the user's pectorals. A back face of the lower panel 12 extends from the waist line 18 to a lateral line 22 proximal to the users trapezius. A left and a right converging arcuate line 24 extends around the shoulders of the user as a dividing line between the upper panel 14 and the lower panel 12 so that the user's shoulders have freedom of movement during the exercise regimen.

Figure 6:
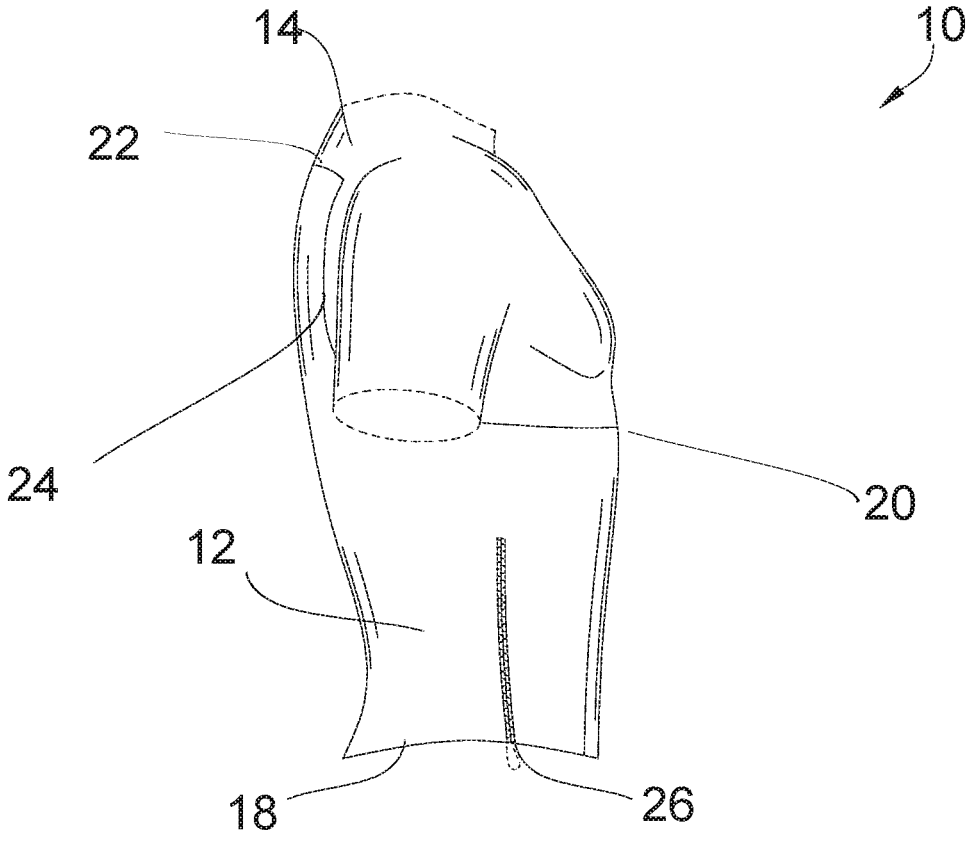
FIG. 6 is a right side view thereof; the left side being a mirror image thereof.
Figure 7:
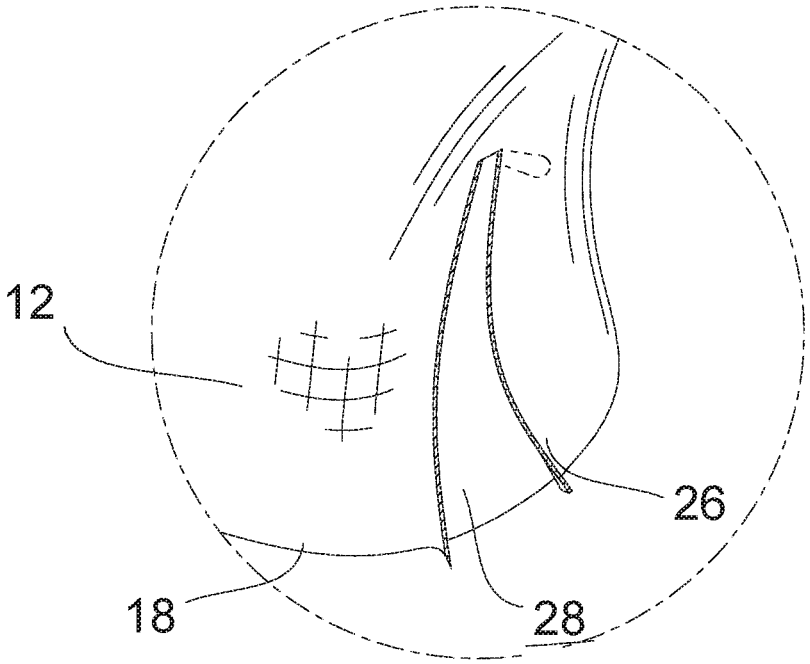
FIG. 7 is a detail side view taken at the area identified by reference numeral 7 of FIG. 1.

As seen in reference to FIGS. 6 and 7, a lateral zipper 26 is provided that extends from the waistline of the lower panel 12 to an upper portion of the lower panel 12. The lateral zipper 26 is operable to close a lateral opening of the lower panel from a top end thereof, to the waistline of the garment 10.

In some embodiments, a closure panel 28 may be provided along the opening of the lateral zipper 26 to partially retain body heat of the wearer when the lateral zippers 26 are in an open position. As the user looses weight and body fat, particularly around the stomach, back, and waistline, the lateral zippers 26 may be closed to further improve the performance of the fitness garment 10 and maintain a close fitting garment 10 as the user shreds excess body fat and water from these areas.

In some embodiments, a reflective strip 30 may be attached to one or more of a sleeve, across a back of the lower panel 12, and a front of the lower panel 12 on opposite sides of the zipper 16. The reflective strip 30 provides visibility of the wearer to motorists and others when illuminated by a light source.

By wearing the fitness garment 10 during physical activity or at rest, the materials and configuration of the lower panel 12 are specifically designed to retain body heat at targeted weight loss areas of the wearer's torso and assists in the removal of excess water weight/body fat with or without exercising.

It should be understood, of course, that the foregoing relates to exemplary embodiments of the invention and that modifications may be made without departing from the spirit and scope of the invention as set forth in the following claims.

What is claimed is:

1. A fitness garment for retaining body heat at targeted areas of a user's torso, comprising:

a lower panel and an upper panel together defining a front face and a back face;

the lower panel consisting of a neoprene material, the lower panel extends along the front face from a waistline to a frontal lateral line proximal to the user's pectoral muscles when worn, the lower panel extends along the back face from the waistline to a back lateral line proximal to the user's upper and middle trapezius muscles when worn, wherein the lower panel is dimensioned for a close conforming fit against a skin surface of a target area of an abdomen and a back to induce sweating and weight loss of the user at the target area;

the upper panel joined to the lower panel, the upper panel extending along the frontal lateral line and the back lateral line, the upper panel including a pair of sleeves, the upper panel adapted to extend across the chest and around the shoulders of the user's body between a neckline and below the pair of sleeves to the lower panel, the upper panel consisting of a flexible breathable fabric selected from the group consisting of spandex or polyester, the upper panel adapted to permit freedom of arm movement during exercise and avoid an overheating condition of the user;

a zipper extends from the waistline to the neckline adjacent to the front face of the garment to permit the user to don the garment and operate the zipper closure to provide the close conforming fit of the lower panel and the upper panel around the user's torso; and a lateral side zipper extends from a bottom edge of the waistline to an upper portion of the lower panel, the lateral side zipper operable to selectively close a lateral side opening extending to a lower edge of the waistline of the lower panel from a top end thereof towards the bottom edge of the waistline.

2. The fitness garment of claim 1, further comprising:

the lateral side zipper operable to selectively adjust the close conforming fit of the lower panel from the top end thereof towards the waistline as the user loses weight at the target area.

3. The fitness garment of claim 2, further comprising:

a closure panel attached to an interior of the lateral side opening, the closure panel formed of the flexible breathable fabric, the closure panel retaining a free end of the lower panel in close conforming fit when the lateral side zipper is in one of an open or a partially open condition.

4. The fitness garment of claim 1, wherein converging arcuate lines divide the upper panel and the lower panel, the converging arcuate lines dimensioned to encircle the user's shoulders, medially spaced apart from a pair of sleeve openings of the pair of sleeves of the fitness garment.

5. The fitness garment of claim 4, further comprising:

the frontal lateral line extending below the sleeve openings and the converging arcuate lines extending towards a neckline past a lower edge of the sleeve openings to the back lateral line.

6. The fitness garment of claim 1, wherein the sleeves are configured as short sleeves.

7. A fitness garment for retaining body heat at targeted areas of a user's torso, comprising:

a lower panel and an upper panel together defining a front face and a back face;

the lower panel consisting of a neoprene material to encircle the user's torso, the lower panel extending from a waistline to a frontal lateral line proximal to the user's pectoral muscles when worn, a back lateral line proximal to the user's trapezius muscles when worn, the front and the back lateral lines interconnected by converging arcuate lines partially circumscribing the user's shoulders when worn, the lower panel is dimensioned for a close torso fit about a target area of an abdomen and a back of the user to induce sweating of the user at the target area;

the upper panel including a pair of sleeves, the upper panel adapted to extend across the chest and around the shoulders of the user's body, the upper panel consisting of a flexible breathable fabric, the converging arcuate lines are medially spaced apart from a sleeve opening of each of the pair of sleeves to permit freedom of arm movement;

the converging arcuate lines dividing the upper panel and the lower panel, the frontal lateral line extending below the sleeve openings and the converging arcuate lines extending towards a neckline past a lower edge of the sleeve openings to the back lateral line that circumscribes at least a portion of the neckline;

a zipper closure extending from the waistline to the neckline of a front face of the fitness garment to permit the user to don the garment and operate the zipper closure to provide a conforming close fit of the lower panel around the user's torso; and a lateral side zipper that extends vertically from a lower edge of the waistline to an upper portion of the lower panel, the lateral side zipper operable to selectively close a lateral side opening of the lower panel from a top end thereof to the bottom edge of the waistline.

8. The fitness garment of claim 7, further comprising:

the lateral side zipper operable to selectively close a lateral side opening of the lower panel from a top end thereof towards the waistline to adjust the close conforming fit as the user loses weight at the target area.

9. The fitness garment of claim 8, further comprising:

a closure panel attached to an interior of the lateral side opening, the closure panel formed of the flexible breathable fabric, the closure panel retaining a free end of the lower panel in the close conforming fit when the lateral side zipper is in an open condition.

10. The fitness garment of claim 7, wherein the sleeves are configured as short sleeves.

11. The fitness garment of claim 7, further comprising:

a first reflective strip attached to one of the pair of sleeves, a second reflective strip attached to the lower panel on the back face, and a third reflective strip and a fourth reflective strip attached to the lower panel on opposite sides of the zipper.

12. A method to promote targeted water and body fat loss around a user's torso, comprising:

providing a fitness garment having a lower panel consisting of a neoprene material extending from a waistline to a frontal lateral line proximal to the user's pectoral muscles when worn, a back lateral line proximal to the user's trapezius muscles when worn, the frontal and the back lateral lines interconnected by converging arcuate lines partially circumscribing the user's shoulders when worn, an upper panel adapted to extend across the chest and around the shoulders of a user's body, the upper panel defining the entirety of sleeve openings, the lower panel dimensioned to a target area corresponding to an abdomen and a back of the user to induce sweating at the target area when worn, the upper panel consisting of a flexible breathable fabric to permit freedom of arm movement, and a zipper closure extending from the waistline to a neckline of a front face of the fitness garment to permit the user to don the garment and operate the zipper closure to provide a close fit of the lower panel around the user's torso, a lateral side zipper that extends vertically from a lower edge of the waistline to an upper portion of the lower panel, the lateral side zipper operable to selectively close a lateral side opening of the lower panel from a top end thereof to the bottom edge of the waistline; and donning the fitness garment over the user's torso.

13. The method of claim 12, further comprising:

selectively operating the zipper to regulate the body temperature of the user.

14. The method of claim 12, further comprising:

operating the lateral side zipper to selectively close the lateral side opening of the lower panel from a top end thereof towards the waistline to tighten the close conforming fit of the lower panel as the user loses weight at the target area.

15. The method of claim 14, further comprising:

selectively operating the lateral side zipper to regulate the body temperature of the user.

16. The method of claim 12, further comprising:

the converging arcuate lines divide the upper panel and the lower panel, the frontal lateral line extending below the sleeve openings and the converging arcuate lines extending towards a neckline past a lower edge of the sleeve openings to the back lateral line to increase the body temperature between shoulders of the user.

* * * * *